US009366121B2

(12) United States Patent
Copeland

(10) Patent No.: US 9,366,121 B2
(45) Date of Patent: Jun. 14, 2016

(54) MODELING FRACTURING FLUID LEAK-OFF

(75) Inventor: Dylan M. Copeland, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 513 days.

(21) Appl. No.: 13/366,582

(22) Filed: Feb. 6, 2012

(65) Prior Publication Data

US 2013/0204588 A1 Aug. 8, 2013

(51) Int. Cl.
*G06G 7/48* (2006.01)
*E21B 43/26* (2006.01)

(52) U.S. Cl.
CPC ..... *E21B 43/26* (2013.01)

(58) Field of Classification Search
CPC ..... E21B 43/26
USPC ..... 703/10
See application file for complete search history.

(56) References Cited

U.S. PATENT DOCUMENTS

| | | | | |
|---|---|---|---|---|
| 7,546,229 | B2 | 6/2009 | Jenny et al. | |
| 2005/0171751 | A1* | 8/2005 | Siebrits et al. | 703/10 |
| 2006/0155473 | A1 | 7/2006 | Soliman et al. | |
| 2006/0200329 | A1* | 9/2006 | Guo et al. | 703/10 |
| 2006/0224370 | A1* | 10/2006 | Siebrits et al. | 703/10 |
| 2007/0170924 | A1* | 7/2007 | Chen et al. | 324/347 |
| 2008/0017576 | A1* | 1/2008 | Belfort et al. | 210/641 |
| 2009/0125280 | A1* | 5/2009 | Soliman et al. | 703/1 |
| 2009/0145599 | A1* | 6/2009 | Siebrits et al. | 166/250.1 |
| 2010/0076738 | A1 | 3/2010 | Dean et al. | |
| 2010/0114544 | A1* | 5/2010 | Dogru | 703/10 |
| 2010/0181073 | A1* | 7/2010 | Dupriest et al. | 166/308.1 |
| 2010/0191511 | A1* | 7/2010 | Hsu et al. | 703/1 |
| 2011/0120702 | A1 | 5/2011 | Craig | |
| 2011/0120705 | A1 | 5/2011 | Walters et al. | |
| 2011/0120706 | A1 | 5/2011 | Craig | |
| 2011/0120718 | A1 | 5/2011 | Craig | |
| 2011/0125471 | A1 | 5/2011 | Craig et al. | |
| 2011/0125476 | A1 | 5/2011 | Craig | |
| 2011/0257944 | A1* | 10/2011 | Du et al. | 703/10 |

OTHER PUBLICATIONS

D.M. Copeland and A. Lin, "A Unified Leadoff and Flowback Model for Fractured Resrvoirs," URTeC: 1918356, Unconventional Resources Technology Conference, Denver, CO, Aug. 25-27, 2014, 10 pages.*

(Continued)

*Primary Examiner* — Hugh Jones
(74) *Attorney, Agent, or Firm* — Holly Soehnge; Fish & Richardson P.C.

(57) ABSTRACT

The present disclosure relates to modeling the flow of fracturing fluid in a subterranean formation. Fluid flow within the reservoir media in a subterranean formation is modeled by a reservoir block flow model. Fluid flow within a fracture network in the reservoir is modeled by a fracture network flow model. Fluid flow between the fracture network and the reservoir media is modeled by an interface flow model. Output data are generated based on coupling the fracture network flow model, the reservoir block flow model, and the interface flow model. The output data represent characteristics of fracturing fluid leak-off from the fracture network into the reservoir media.

18 Claims, 6 Drawing Sheets

(56) References Cited

OTHER PUBLICATIONS

J.M. McGowen et al., "Incorporating Crossflow and Spurt-Loss Effects in Filtration Modeling Within a Fully 3D Fracture-Growth Simulator," SPE 56597, Society of Petroleum Engineers Inc., 1999 SPE Annual Technical Conference and Exhibition, Houston, TX, Oct. 3-6, 1999, 14 pages.*

Ely Ezer Lolon et al: Application of 3-D Reservoir Simulator for Hydraulically Fractured Wells; Poceedings of Asia Pacific Oil and Gas Conference and Exhibition, 2007; 8 pp.*

Charoenwongsa et al: "A Fully-Coupled Geomechanics and Flow Model for Hydraulic Fracturing and Reservoir Engineering Applications", 2010; 31 pp.*

Josef Shaoul et al: "Developing a Tool for Reservoir Simulation of Hydraulically Fractured Wells", SPE Reservoir Evaluation & Engineering, vol. 10, No. 1, 2005; 10 pp.*

Hustedt et al: "Integrated Data Analysis & Dynamic Fracture Modeling Key to Understanding Complex Waterfloods: Case Study of the Pierce Field, North Sea", SPE Reservoir Evaluation & Engineering, vol. 13, No. 1, 2010; 13 pp.*

Lujun Ji et al: A Novel Hydraulic Fracturing Model Fully Coupled With Geornechanics and Reservoir Simulation, SPE Journal, vol. 14, No. 3, 2009; 8 pp.*

Karimi-Faro et al: An Efficient Discrete-Fracture Model Applicable for General-Purpose Reservoir Simulators, SPE Journal, vol. 9, No. 2, 1 2004; 11 pp.*

International Search Report and Written Opinion in International Application No. PCT/US2013/020777, mailed Jul. 31, 2013, 14 pages.

Charoenwongsa et al. "A Fully-Coupled Geomechanics and Flow Model for Hydraulic Fracturing and Reservoir Engineering Applications," *Canadian Unconventional Resources & Int'l Petroleum Conf.*, Oct. 19-21, 2010, pp. 1-31.

Hustedt et al., "Integrated Data Analysis and Dynamic Fracture Modeling Key to Understanding Complex Waterfloods: Case Study of the Pierce Field, North Sea," *SPE Reservoir Evaluation & Engineering*, Feb. 1, 2010, pp. 82-94.

Ji et al., "A Novel Hydraulic Fracturing Model Fully Coupled with Geomechanics and Reservoir Simulation," *SPE J*, Sep. 1, 2009, 14(3):423-430.

Karimi-Fard et al., "An Efficient Discrete-Fracture Model Applicable for General-Purpose Reservoir Simulators," *SPE J*, Jun. 1, 2004, 9(2):227-236.

Lolon et al., "Application of 3-D Reservoir Simulator for Hydraulically Fractured Wells," *Proc Asia Pacific Oil & Gas Conf & Exhibition*, Jan. 1, 2007, pp. 1-8.

Shaoul et al., "Developing a Tool for 3D Reservoir Simulation of Hydraulically Fractured Wells," *SPE Reservoir Evaluation & Engineering*, Feb. 1, 2007, 10(1)50-59.

Authorized Officer Philippe Becamel, PCT International Preliminary Report on Patentability, PCT/US2013/020777, Aug. 21, 2014, 9 pages.

Patent Examination Report No. 1, Australian Patent Application No. 2013217721, Jul. 2, 2015, 3 pages.

McGowen, J.M., Barree, R.D., Conway, M.W., "Incorporating Crossflow and Spurt-Loss Effects in Filtration Modeling Within a Fully 3D Fracture-Growth Simulator," SPE 56597, 1999 SPE Annual Technical Conference and Exhibition, Houston, TX, Oct. 1999, 14 pages.

Barree, R.D., Mukherjee, H., "Determination of Pressure Dependent Leakoff and Its Effect on Fracture Geometry," SPE 36424, 71st Annual Technical Conference and Exhibition, Denver, CO, Oct. 1996, 10 pages.

Meyer, B.R., Jacot, R.H., "Implementation of Fracture Calibration Equations for Pressure Dependent Leakoff," SPE 62545, 2000 SPE/AAPG Western Regional Meeting, Long Beach, CA, Jun. 2000, 20 pages.

Efendiev, Y., Hou, T.Y., "Multiscale Finite Element Methods: Theory and Applications," Chapter 2, ISBN 0387094954, 9780387094953, Springer, 2009, 45 pages.

Bangerth, W., Rannacher, R., "Adaptive Finite Element Methods for Differential Equations," Chapter 3, ISBN 978-3-7643-7009-1, Birkhauser, 2003, 16 pages.

* cited by examiner

440

MODELING FRACTURING FLUID LEAK-OFF

BACKGROUND

The present disclosure relates to modeling the flow of fracturing fluid in a subterranean formation. Fracturing fluid is often injected into subterranean reservoirs, for example, to fracture the reservoir rock. In some instances, a portion of the fracturing fluid may leak off from the fractures into the porous media of the reservoir. In some contexts, computers have been used to model the flow of fluids in subterranean reservoirs.

SUMMARY

In a general aspect, methods, systems, and software can be used to model fluid flow in a subterranean reservoir. In some instances, the flow of fracturing fluid from the fracture network into porous reservoir rock is modeled.

In some aspects, fluid flow within reservoir media in a subterranean formation is modeled with a reservoir block flow model. Fluid flow within a fracture network in the reservoir is modeled with a fracture network flow model. Fluid flow between the fracture network and the reservoir media is modeled with an interface flow model. Output data are generated based on coupling the fracture network flow model, the reservoir block flow model, and the interface flow model. The output data represent characteristics of fracturing fluid leak-off from the fracture network into the reservoir media.

Implementations of these and other aspects may include one or more of the following features. The characteristics of fracturing fluid leak-off include a time-dependent volume of fracturing fluid leak-off from the fracture network into the reservoir media, a time-dependent rate of fracturing fluid leak-off from the fracture network into the reservoir media, or both. The reservoir block flow model identifies boundaries of the reservoir media. The fracture network flow model identifies fracture segments along the boundaries of the reservoir media. The interface flow model represents fluid leak-off for each of the fracture segments individually.

Additionally or alternatively, implementations of these and other aspects may include one or more of the following features. The fracture network flow model includes a first system of differential equations. The reservoir block flow model includes a second system of differential equations. The interface flow model includes a third set of equations that couples the first system of differential equations with the second system of differential equations. The output data are generated based on solving a time-dependent system of coupled differential equations. The time-dependent system of coupled differential equations can include the first system of differential equations and the second system of differential equations coupled by the third set of equations. The first system of differential equations and the second system of differential equations may have one unique solution for different input parameters.

Additionally or alternatively, implementations of these and other aspects may include one or more of the following features. The reservoir block flow model and the fracture network flow model are used to model the flow of the fracturing fluid and at least one other fluid. The other fluid can include natural resources of the reservoir or other fluids. The reservoir block flow model and the fracture network flow model are used to model the flow of multiple fluid phases. The reservoir block flow model can be used to model fluid flow in one spatial dimension, in two spatial dimensions or in three spatial dimensions. The fracture network flow model can be used to model fluid flow in one spatial dimension, in two spatial dimensions or in three spatial dimensions.

Additionally or alternatively, implementations of these and other aspects may include one or more of the following features. The output data includes concentration data for fracturing fluid and reservoir fluid, fluid loss distribution data, pressure data, pressure distribution data, temperature data, temperature distribution data, data relating to the concentration and reaction of chemical species, or any suitable combination. The output relates to injected fluids, natural fluids of the reservoir, or both. In some instances, the reservoir media can include porous rock. The reservoir block flow model includes a mesh representation of the reservoir media. Time-dependent modifications can be made to the mesh representation. The time-dependent modifications to the mesh representation can be based on a model of time-dependent fluid flow in the reservoir media.

The details of one or more implementations of the subject matter described in this specification are set forth in the accompanying drawings and the description below. Other features, aspects, and advantages of the subject matter will become apparent from the description, the drawings, and the claims.

DESCRIPTION OF DRAWINGS

Like reference symbols in the various drawings indicate like elements.

DETAILED DESCRIPTION

When fracturing fluid is injected into a reservoir, a portion of the fracturing fluid may leak off from the fractures into the porous reservoir media. The dynamics of the fracturing fluid in the subterranean reservoir can be modeled numerically on a computer system. Such models can be used, for example, to design a fracture treatment plan, to estimate costs and materials needed for a fracture treatment plan, to simulate a fracture treatment in real time with data input in real time, or for any other suitable purpose.

In some cases, computer simulations are used to calculate dynamic characteristics of fracture fluid leak-off from the fracture network to the reservoir media. For example, computer simulations may be used to estimate a time-dependent volume of fracturing fluid leak-off, a time-dependent rate of fracturing fluid leak-off, or a combination of these and other characteristics of fracturing fluid leak-off. In some implementations, multi-dimensional fluid leak-off in complex fracture networks can be modeled. In some instances, arbitrary polygonal or polyhedral geometry may be used to model the reservoir. Numerical models may be used to simulate the flow of multiple different types of fluids (e.g., fracturing fluid, water, hydrocarbons, etc.), which may include multiple different fluid phases (e.g., gas, liquid, etc.).

Computer simulations of fluid flow in a subterranean reservoir may provide many different types of output data in various contexts. In some examples, computer simulations provide calculations or estimates relating to the volume and rate of fluid loss, the distribution of the concentration of leaked-off fluid and reservoir fluids in the porous media, the distribution of pressure and temperature throughout the reservoir, or any suitable combination of these and other data. In some cases, numerical simulations produce output data representing temporal variations in reservoir properties.

Figure 1A:
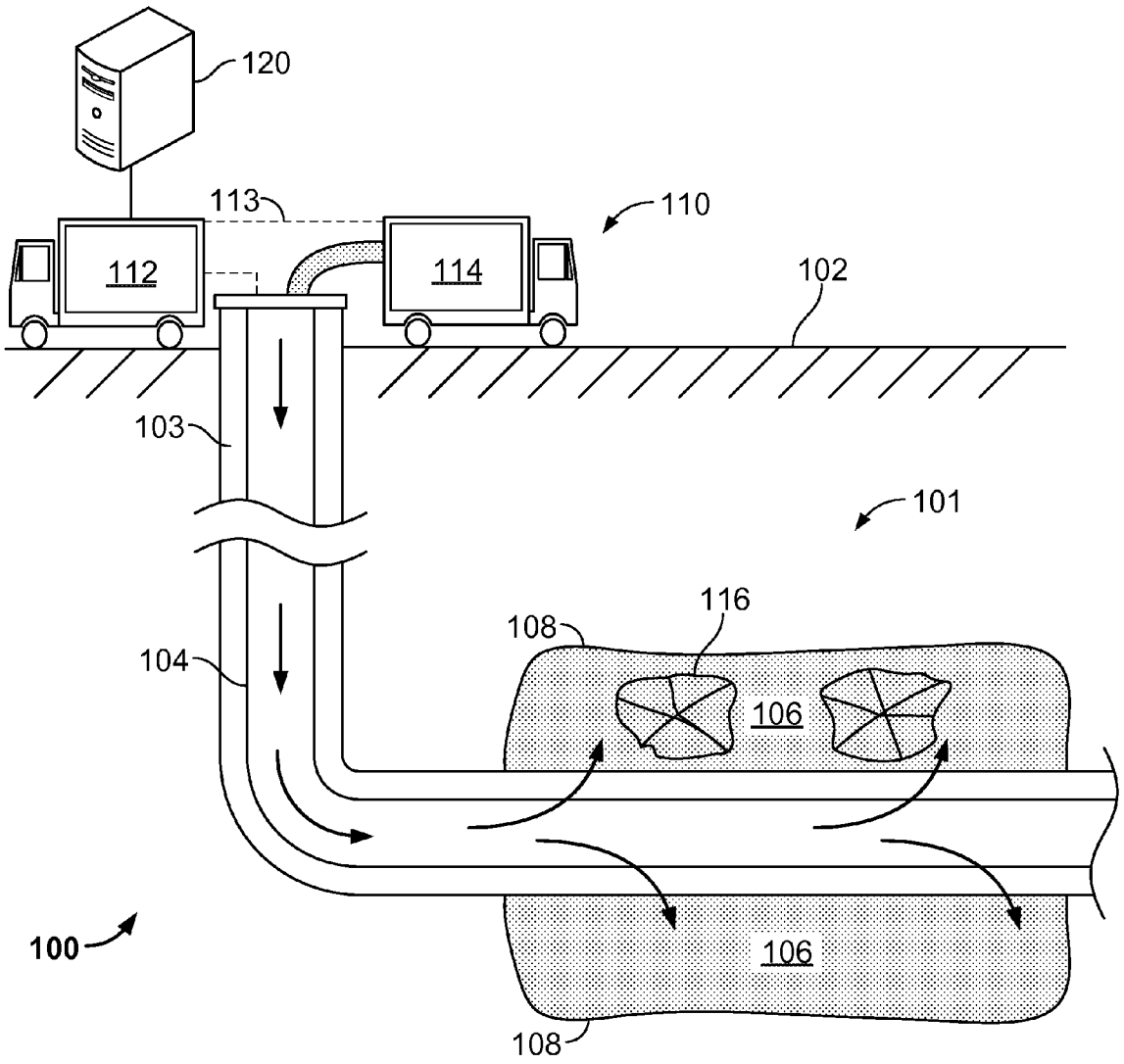
FIG. 1A is a diagram of an example well system for applying a fracture treatment to a subterranean formation.

FIG. 1A is a diagram of an example well system 100 for applying a fracture treatment to a subterranean formation 101. Fracture treatments may be used, for example, to form or propagate fractures in a rock layer by injecting pressurized fluid. The fracture treatment may enhance or otherwise influence production of petroleum, natural gas, coal seam gas, or other types of reservoir resources. Fracture treatments may be used for other purposes. The example well system 100 includes an injection system 110 that applies fracturing fluid 108 to a reservoir 106 in the subterranean formation 101. The injection system 110 includes control trucks 112, pump trucks 114, a wellbore 103, a working string 104 and other equipment. In the example shown in FIG. 1A, the pump trucks 114, the control trucks 112 and other related equipment are above the surface 102, and the wellbore 103, the working string 104, and other equipment are beneath the surface 102. An injection system can be configured as shown in FIG. 1A or in a different manner, and may include additional or different features as appropriate. The injection system 110 may be deployed in any suitable environment, for example, via skid equipment, a marine vessel, sub-sea deployed equipment, or other types of equipment.

The wellbore 103 shown in FIG. 1A includes vertical and horizontal sections, and the fracturing fluid 108 is applied to the reservoir 106, which resides near the wellbore 103. Generally, a wellbore may include horizontal, vertical, slant, curved, and other types of wellbore geometries and orientations, and the fracture treatment may generally be applied to any portion of a subterranean formation 101. The wellbore 103 can include a casing that is cemented or otherwise secured to the wellbore wall. The wellbore 103 can be uncased or include uncased sections. Perforations can be formed in the casing to allow fracturing fluids and/or other materials to flow into the reservoir 106. Perforations can be formed using shape charges, a perforating gun, and/or other tools.

The pump trucks 114 may include mobile vehicles, immobile installations, skids, hoses, tubes, fluid tanks or reservoirs, pumps, valves, and/or other suitable structures and equipment. The pump trucks 114 can communicate with the control trucks 112, for example, by a communication link 113. The pump trucks 114 are coupled to the working string 104 to communicate the fracturing fluid 108 into the wellbore 103. The working string 104 may include coiled tubing, sectioned pipe, and/or other structures that communicate fluid through the wellbore 103. The working string 104 can include flow control devices, bypass valves, ports, and or other tools or well devices that control the flow of fluid from the interior of the working string 104 into the reservoir 106.

The fracturing fluid 108 can include any appropriate fluid or fluid composition. For example, the fracturing fluid 108 can include hydraulic fracturing fluids, chemical treatment fluids, and other types of fluids. The fracturing fluid 108 may include proppant-laden fluids, thin fluids, gels, foams, additives, water, slurry, liquids, gases or any suitable combination. The techniques described here may be used to model the flow of fluids that are injected for purposes other than fracturing. As such, the fracturing fluid 108 may generally include fluids injected for applying fracture treatments, chemical treatments, heat treatments, or any suitable combination of these and other fluids.

The control trucks 112 can include mobile vehicles, immobile installations, and/or other suitable structures. The control trucks 112 can control and/or monitor the injection treatment. For example, the control trucks 112 may include communication links that allow the control trucks 112 to communicate with tools, sensors, and/or other devices installed in the wellbore 103. The control trucks 112 may receive data from, or otherwise communicate with, a computing system 120 that models one or more aspects of the fracture treatment. In addition, the control trucks 112 may include communication links that allow the control trucks 112 to communicate with the pump trucks 114 and/or other systems. The control trucks 112 may include an injection control system that controls the flow of the fracturing fluid 108 into the reservoir 106. For example, the control trucks 112 may monitor and/or control the density, volume, flow rate, flow pressure, location, proppant, and/or other properties of the fracturing fluid 108 injected into the reservoir 106.

The reservoir 106 can include a fracture network 116, as shown in FIG. 1A. Some or all of the fracture network 116 can be selected for analysis by the computing system 120. For example, given an area (e.g., surrounding the wellbore 103), a subset of the area (e.g., defined by a selected width, depth, and length) or all of the area can be modeled by the computing system 120.

In one aspect of operation, the injection system 110 applies a fracture treatment to the reservoir 106. The control truck 112 controls and monitors the pump truck 114, which pumps the fracturing fluid 108 through the work string 104, into the wellbore 103, and subsequently into the reservoir 106. The fracturing fluid 108 can be injected at a pressure that fractures the reservoir media in the reservoir 106. Some aspects of the fracture treatment may be selected, tuned, or otherwise parameterized based on information provided by the computing system 120, in real time or based on prior treatments (e.g., prior treatments in similar settings, etc.). For example, the fracture treatment may be designed based or adjusted in real time in part on computer simulations indicating a rate of fracture fluid leak-off in the reservoir 106.

Figure 1B:
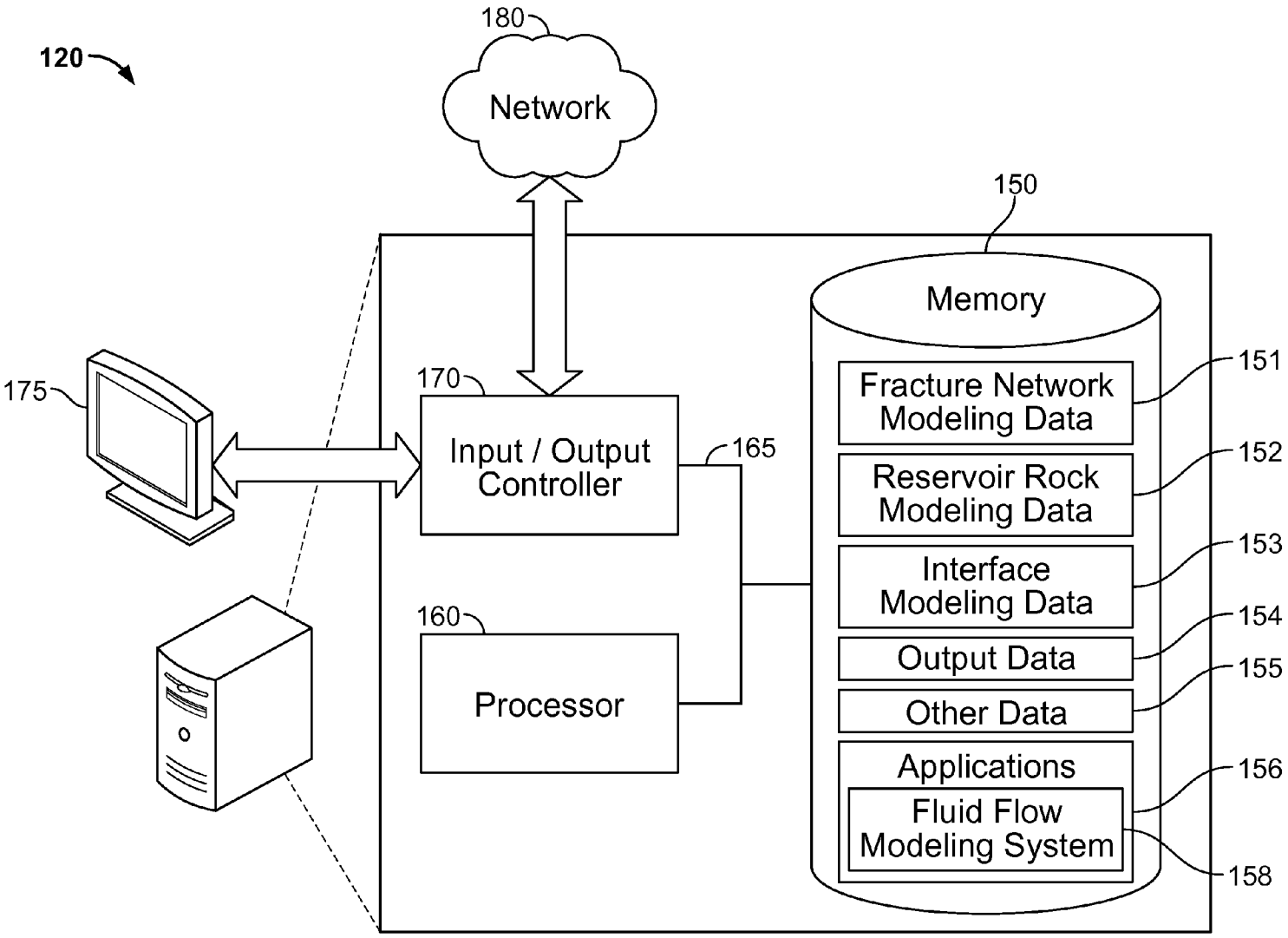
FIG. 1B is a diagram of an example computer system.

FIG. 1B is a diagram of the example computing system 120. The example computing system 120 can be located at or near one or more wells of the well system 100 and/or at another location. In some implementations, the computing system 120 can communicate with a well control system. In some implementations, the computing system 120 has no communication with a well system or any component of a well system. Although FIG. 1A shows the computing system 120 operating in coordination with the well system 100, a computing system 120 can be implemented completely independent of a well system. For example, the computing system 120 may model the dynamics of fracturing fluid in any subterranean reservoir, whether or not the reservoir is associated with any well system or injection system.

The example computing system 120 shown in FIG. 1B includes a processor 160, a memory 150, and input/output controllers 170 communicably coupled by a bus 165. The processor 160 may include a single processor or multiple processors, and may include one or more processors operating remotely. The memory 150 can include, for example, a random access memory (RAM), a storage device (e.g., a writable read-only memory (ROM) and/or others), a hard disk, and/or another type of storage medium. The computing system 120 can be preprogrammed and/or it can be programmed (and reprogrammed) by loading a program from another source (e.g., from a CD-ROM, from another computer device through a data network, and/or in another manner). The input/output controller 170 is coupled to input/output devices (e.g., a monitor 175, a mouse, a keyboard, and/or other input/output devices) and to a network 180. The input/output devices receive and transmit data in analog or digital form over communication links such as a serial link, wireless link (e.g., infrared, radio frequency, and/or others), parallel link, and/or another type of link.

The network 180 can include any type of data communication network. For example, the network 180 can include a wireless and/or a wired network, a Local Area Network (LAN), a Wide Area Network (WAN), a private network, a public network (such as the Internet), a WiFi network, a network that includes a satellite link, and/or another type of data communication network.

The memory 150 can store instructions (e.g., computer code) associated with an operating system, computer applications, and/or other resources. The memory 150 can also store application data and data objects that can be interpreted by one or more applications and/or virtual machines running on the computing system 120. As shown in FIG. 1B, the example memory 150 includes fracture network modeling data 151, reservoir block modeling data 152, interface modeling data 153, output data 154, other data 155, and applications 156. In some implementations, a memory of a computing device may include some or all of the information stored in the example memory 150 in FIG. 1B.

The example fracture network modeling data 151 includes information that can be used to model fluid flow in a fracture network in a subterranean formation. The fracture network modeling data 151 may include information identifying properties of the fracture network. For example, the fracture network modeling data 151 may identify the geometric properties, material properties, and other properties of a subterranean fracture network. The properties of the fracture network may be based on measurements (e.g., well logs, outcroppings, etc.), calculations, estimates, or other sources. The fracture network modeling data 151 can include equations, parameters, data sets, or any suitable information that can be used to model fluid flow in a fracture network. The fracture network modeling data 151 may vary temporally, in size, format, standards and other attributes. These attributes may be selected for conveniently coupling with other models and systems, such as a reservoir block model or others.

The example reservoir block modeling data 152 includes information that can be used to model fluid flow in reservoir media in a subterranean formation. The reservoir block modeling data 152 may include information identifying properties of the reservoir media. For example, the reservoir block modeling data 152 may identify the geometric properties, material properties (e.g., porosity, permeability, etc.), and other properties of the media that constitute the reservoir. The properties of the reservoir media may be based on measurements (e.g., well logs, outcroppings, etc.), calculations, estimates, or other sources. In some cases, the reservoir block modeling data 152 includes grids or similar data structures that can be used to model the reservoir. The reservoir block modeling data 152 can include equations, parameters, data sets, or any suitable information that can be used to model fluid flow in reservoir media. The reservoir block modeling data 152 may vary temporally, in size, format, standards and other attributes. These attributes may be selected for conveniently coupling with other models and systems, such as a fracture network model or others.

The example interface modeling data 153 includes information that can be used to model fluid flow across an interface between a fracture network and reservoir media. The interface modeling data 153 may include information identifying segments or other sections of the interface between the fracture network and the reservoir media. The interface modeling data 153 may identify the geometric properties, material properties, and other properties of the interface. The interface modeling data 153 can include equations, parameters, data sets, or any suitable information that can be used to couple the fracture network fluid flow model and the reservoir block fluid model. The interface modeling data 153 may vary temporally, in size, format, standards and other attributes.

The example output data 154 includes information generated by numerical simulations of fluid flow in the subterranean reservoir. The output data 154 can include information generated based on an interface flow model that couples the fracture network flow model with the reservoir block flow model. The output data can also include parameters and codes defining a data presentation or other graphical display.

The applications 156 can include software applications, scripts, programs, functions, executables, and/or other modules that are interpreted and/or executed by the processor 160. For example, the applications 156 can include software applications, scripts, programs, functions, executables, and/or other modules that operate alone or in combination as a fluid flow modeling system 158. Such applications may include machine-readable instructions for performing one or more of the operations shown in FIG. 5. The applications 156, including the fluid flow modeling system 158, can obtain input data, such as the fracture network modeling data 151, the reservoir block modeling data 152, the interface modeling data 153, and/or other types of input data, from the memory 150, from another local source, and/or from one or more remote sources (e.g., via the network 180). The applications 156, including the fluid flow modeling system 158, can generate output data and store the output data in the memory 150, in another local medium, and/or in one or more remote devices (e.g., by sending the output data via the network 180).

The processor 160 can execute instructions, for example, to generate output data based on data inputs. For example, the processor 160 can run the applications 156 by executing and/or interpreting the software, scripts, programs, functions, executables, and/or other modules contained in the applications 156. The processor 160 may perform one or more of the operations shown in FIG. 5. The input data received by the processor 160 and/or the output data generated by the processor 160 may include any of the fracture network modeling data 151, the reservoir block modeling data 152, the interface modeling data 153, the output data 154, and/or the other data 155.

The fluid flow modeling system 158 may be implemented using any suitable technique. In some implementations, the fluid flow modeling system 158 uses fracture networks and reservoir blocks to model fracturing fluid leak-off. The spatial dimension of the fracture networks may differ from those of the reservoir blocks. Moreover, the individual fractures may be modeled in different spatial dimensions, and the individual reservoir blocks may be modeled in different spatial dimensions. For example, a one- or two-dimensional fracture network model may be coupled with a two- or three-dimensional reservoir block model. In some instances, computational costs can be saved by modeling fewer spatial dimensions, while more spatial dimensions may provide additional useful information. The fracture network and reservoir blocks may have different orientations in space. For example, a two-dimensional model of the reservoir blocks may lie in a horizontal plane, while a two-dimensional model of the fractures may lie in vertical planes so that gravity effects on the fluids and proppants can be addressed. Generally, any suitable number of spatial dimensions may be used to model the fracture network and the reservoir media.

The fluid flow modeling system 158 may produce analytic or numerical solutions of a system of time-dependent differential equations describing the flow of fracturing fluids and reservoir fluids in the blocks of porous media of the reservoir. In some instances, the flow of fracturing fluids inside the complex fracture network is described by a different set of time-dependent differential equations, which may be of different spatial dimension. Coupling these systems together can produce a global flow model for the fracturing fluids and the reservoir fluids throughout the reservoir that includes the fracture network and the reservoir blocks. The fluid flow modeling system 158 can couple these systems using an interface model that describes the process of fluid leaking off from the fractures to the reservoir blocks that matches empirical data. The fluid flow modeling system 158 can also incorporate the physics of the interactions between the fracturing fluid, the fracture face, the porous media, and the reservoir fluids within the porous media. Further, the fluid flow modeling system 158 may be configured to provide time-dependent, multi-dimensional data throughout the fracture network and the reservoir, or any suitable domain or region within the reservoir.

The interface model that couples flow between the fracture network and the reservoir media can be based on one or more fluid leak-off models. A fluid leak-off model can provide a computational model for fluid loss volume and rate from a single fracture, or in some cases from multiple fractures. For example, a fluid leak-off model can be defined on a "bi-wing" fracture lying in a plane. The fluid flow modeling system 158 can apply a fluid leak-off model to segments of a fracture network. For example, the fluid leak-off model can be applied to entire fractures in the fracture network, or to smaller or larger segments of individual fractures (e.g., a fine-scale discretization). A fluid leak-off model can be applied to fractures not contained within a plane (e.g., a fracture with a corner). As such, segments need not be planar and need not be contained in individual fractures, but rather may include joints between two or more fractures.

In some implementations, greater accuracy and higher resolution can be attained by using smaller segments. Within each segment, the fluid loss volume and rate can be variables in the global model. The fluid loss volume and rate and other similar values can be directly identified with the corresponding variables in a fluid leak-off model. In some implementations, the variables in the global model can be related by mathematical functions (e.g. averages or piecewise polynomials) to the variables in a fluid leak-off model. Thus, a fracture network can be partitioned into one or more fracture segments that can be individually modeled by appropriate leak-off models.

In the fluid flow modeling system 158, equations describing fluid flow in the fracture network and equations describing fluid flow in the reservoir blocks can be coupled through the fracture segments. The fracture segments may lie along the boundaries of reservoir blocks. In some instances, fractures may be modeled inside reservoir blocks. In some instances, the velocity of fracturing fluid in the direction normal to each fracture segment (e.g., from the fracture network into the reservoir blocks) can be approximated as a function of the fluid loss rate given by a fluid leak-off model. Flux boundary conditions or source functions can be defined in the systems of equations in the fracture segments and the reservoir blocks, based on this velocity. These boundary conditions or source functions can be defined so as to conserve the total mass in the global model. As such, the rate of fluid mass lost from each fracture segment may equal the rate of fluid mass gained by the reservoir block through that fracture face.

In some cases, coupling based on fluid leak-off models may involve certain physical parameters and variables defined both in the reservoir blocks and the fractures. For example, the leak-off models may involve pressure, velocity, temperature, fluid viscosity, and others. Those parameters and variables can be defined both in the fracture network and the reservoir media, and they can be coupled by the interface model. The strength of the coupling may depend on the parameters or properties of the fluid leak-off model. In some cases, leak-off models provide strong coupling between the fracture network and reservoir media. Even if the interface model does not explicitly depend on or affect a particular parameter or variable, there may be an implicit dependency or effect, which can result in weak coupling. Thus, a fluid leak-off model may affect the coupling of parameters and variables in the global model. A fluid leak-off model can be designed or selected with the purpose of obtaining a weak or strong coupling of certain parameters and variables.

As such, an interface model can incorporate fluid leak-off models for multiple different segments in the fracture network. Any suitable fluid leak-off model or combinations of fluid leak-off models may be used. An example fluid leak-off model is provided by the filtration with linear-invasion and crossflow (FLIC) model. The FLIC model can be used to relate the volumetric fluid loss rate at the fracture's interface to the pressure values in the fracture and in the reservoir block as follows:

$$\Delta P_w = \Delta P_w^{ref}\left(\frac{v_s}{\alpha_d}\right)^{\frac{1}{2\kappa}},$$

with $$\alpha_d = \frac{C_w^{*2} + \sqrt{C_w^{*4} + C_d^* C_w^{*2}(V - V_0)}}{V - V_0} + C_d^*$$

where $\Delta P_w$ is the pressure drop across the filter-cake (a polymer deposition made by the fracturing fluid) on the fracture face (i.e., the fracture pressure minus the reservoir pressure at the fracture), $v_s$ is the superficial velocity of the fracturing fluid, V is the volume of fluid leaked off from the fracture, $V_0$, is the spurt volume, κ is the filter-cake compressibility factor, and the constants $C_d^*$ and $C_w^*$ are defined based on parameters empirically determined at reference conditions.

Fluid leak-off models may incorporate additional or different terms or parameters, as appropriate. For example, fluid leak-off models may incorporate terms describing the pressure drop across the viscous invaded region of the reservoir (near the fracture) and the compressible region of the reservoir (far from the fracture). These terms can be replaced by a more complex reservoir flow model. For example, coupling can be made by using a fluid leak-off model only to describe the dynamic filter-cake and the interface between the fracture flow and reservoir media flow. Such modeling may result in a strong, direct coupling of pressures. Velocities may be weakly coupled, for example, in the following indirect manner. In some instances, the fracture network flow model may not include the velocity component normal to the fractures. The fluid loss may be modeled in the fractures simply as a source function, yielding a mass flux. Velocity in the reservoir block may be modeled in all physical dimensions, including the direction normal to the fracture faces, while modeling velocity in the fractures only in the plane of the fracture face. Thus, the reservoir block system may have a normal velocity component not included in the fracture network model. A weak coupling of velocities still exists, as the normal velocity in a reservoir block influences the mass flux source term in adjacent fractures and hence indirectly influences the tangential velocity in the fractures.

The fluid flow modeling system 158 can produce physically realistic results. For example, the global system (e.g., the fracture network and the reservoir media together with the interface model) may have a unique solution for all inputs. The data inputs may include a physically admissible set of input parameters (including time), and the solution can be a model state that satisfies all of the system equations. In other words, the coupling can be implemented without introducing singularities. As such, in some instances there are no inputs for which there are (i) multiple solutions, (ii) no solutions, or (iii) no physically admissible solutions. This mathematical condition can be met, for example, by using an interface model that incorporates the FLIC model or other types of fluid leak-off models. Indeed, a positive fluid leak-off rate can cause an increase of pressure in the reservoir blocks as time elapses. The increasing pressure does not exceed the pressure in neighboring fractures, for example, since the FLIC model reduces the leak-off rate to zero as pressure equilibrium is approached. Thus the pressure, a coupled variable in this example, remains within physically meaningful bounds for which all system equations have unique solutions.

The fluid flow modeling system 158 can be implemented with generality and flexibility to allow for complex physical models in the fracture network and reservoir media. For example, the fluid flow modeling system 158 can utilize an interface flow model in conjunction with a fracture flow model and a reservoir flow model that significantly extends fluid leak-off models and greatly exceed their complexity. The interface flow model may match empirical data and model complex physical phenomena. For example, the interface flow model may be used in the context of the fluid flow modeling system 158 to model complex physical phenomena that are far more complex than some other fluid leak-off models.

The fluid flow modeling system 158 may model physical phenomena associated with any or all parts of the physical domain, including the fractures, the reservoir media, the fracture faces, etc. The fluid flow modeling system 158 can account for varying porous media and multiple fluid types and phases throughout the reservoir. In some instances, this may be accomplished, for example, by modeling heterogeneities in the porous reservoir media, by modeling the relative permeability to the fracturing fluid when multiple pre-existing fluids and phases are present in the reservoir, and by other considerations.

In some implementations, an interface flow model allows for any suitable fracture network flow model and reservoir block flow model to be used. For example, the flow in the fracture network may be modeled by the Navier-Stokes equations or a simplification thereof, together with a proppant transport model. The flow of leaked-off fracturing fluid and reservoir fluids (e.g., oil, water, gas) may be described by the Black Oil model with velocity given by Darcy's law or Forchheimer's law. Both of these models involve the variables of pressure and velocity of the fracturing fluid, which can be utilized in fluid leak-off models. The equations may be solved numerically, for example, by a finite difference method in time and a finite volume method or discontinuous Galerkin method in space. Moreover, different numerical solution methods can be used in the fracture network and reservoir blocks. Analytical solutions for some equations can also be used in some situations. For example, physical parameters can be taken as constants in some regions of the computational domain if an analytical solution is available. In such instances, a resulting loss of accuracy may be acceptable for the circumstances.

The interface flow model may use multiple different fluid leak-off models in different parts of the reservoir. More sophisticated models can be used in fracture segments with complex behavior, for example in the vicinity of wellbores, near junctions where multiple fractures meet, and near the fracture tips. In some cases, the interface flow model can track the dynamic evolution of a filter cake, including fracturing fluid polymers deposited on the fracture face. In a similar manner, the global model can model formation damage resulting from the invading polymers.

In some cases, the fluid flow modeling system 158 can model multiple fluids and phases. This may allow for more accurate modeling of fluid loss volume and rate. Modeling multiple fluids and phases may also facilitate temperature modeling and the tracking of fluids and chemicals, which can provide information about the fracturing process in real time. This additional information can also serve to calibrate and validate the overall fracturing model.

Figure 2:
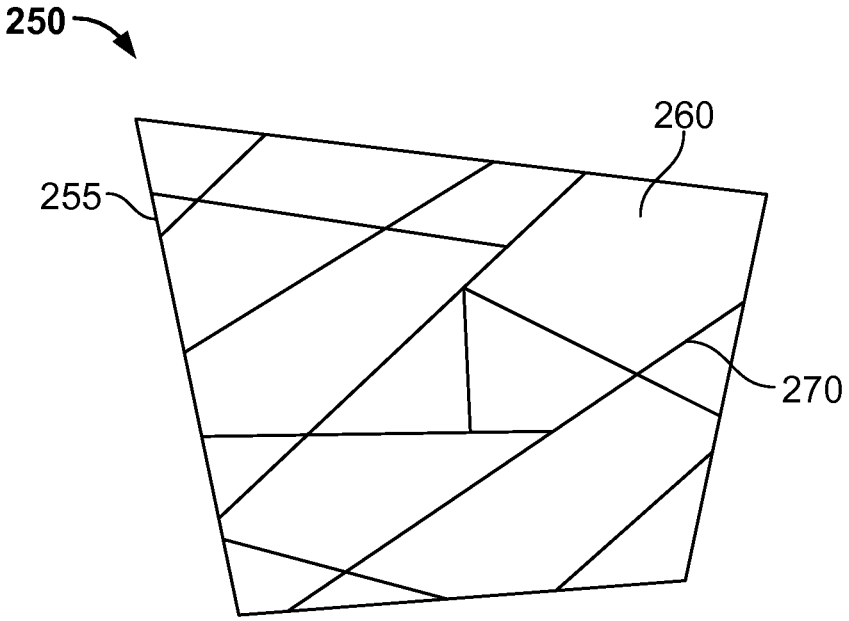
FIG. 2 is a diagram showing example reservoir blocks.

FIG. 2 is a diagram showing example reservoir blocks in a computation region 250. The computation region 250 can be selected, for example, from the reservoir 106 in FIG. 1A, or the computation region 250 can be designed based on any suitable data or criteria. The computation region 250 may itself be time-dependent; for example, it may grow spatially as the fracture network extends farther in space. Multiple computation regions 250 or multiple fracture networks, or both, may be designed for multiple fracturing treatment stages. In such cases, the different computation regions and their fracture networks may overlap or interact, or they may be independent.

The computation region 250 can include a time-dependent complex fracture network 270 that divides the region 250 into a number of the reservoir blocks 260. In the example shown in FIG. 2, the line segments between the reservoir blocks 260 represent fractures, which may be open or closed at different times. The region 250 is bounded by a boundary. The computation region 250 can be an arbitrary, unstructured polygonal or polyhedral geometry in a reservoir that is partitioned into blocks. In some instances, the fracture network 270 begins with a small number of open fractures near the wellbore and grows as fluid is injected at high pressures. Thus, the fracture network 270 does not always extend to the boundary 255, as shown in FIG. 2, and may close when the fracture pressure decreases.

The computation region 250 can model the flow of fracturing fluid, reservoir fluids, and other fluids throughout the fracture network 270 and the reservoir during injection and production. The computation region 250 may also model other types of physical phenomena of interest (e.g., fracture and rock mechanics, proppant transport, reservoir fluid production, etc.). Since the fracture network 270 may not always extend to the boundary 255, for computational convenience and efficiency, the fracture network 270 can be augmented to obtain a partition of the entire computation domain, in which the reservoir blocks 260 satisfy some criteria, for example, size, convexity, geometric complexity, etc. The result of the augmentation may be similar to the illustration in FIG. 2, where not all of the line segments are open fractures. The reservoir blocks 260 may have open fractures on parts of their boundaries. Some of the segments in the fracture network 270 may not correspond to physical fractures but may be interpreted as closed fractures. In some cases, the physical fractures in the network 270 may be closed initially but open later in time, and may close when the fracture pressure decreases.

In some instances, some fractures or fracture segments may lie inside reservoir blocks 260. Such fractures can be modeled as part of the fracture network, with the fracture network's governing equations, or as part of the reservoir block, with the reservoir block's governing equations. In the former case, there may be some reservoir blocks cut by fractures, with flux boundary conditions also defined on the fractures inside the reservoir block. In the latter case, fractures may be modeled within reservoir blocks by defining different fluid properties and higher permeability and porosity in their locations, for example.

Figure 3:
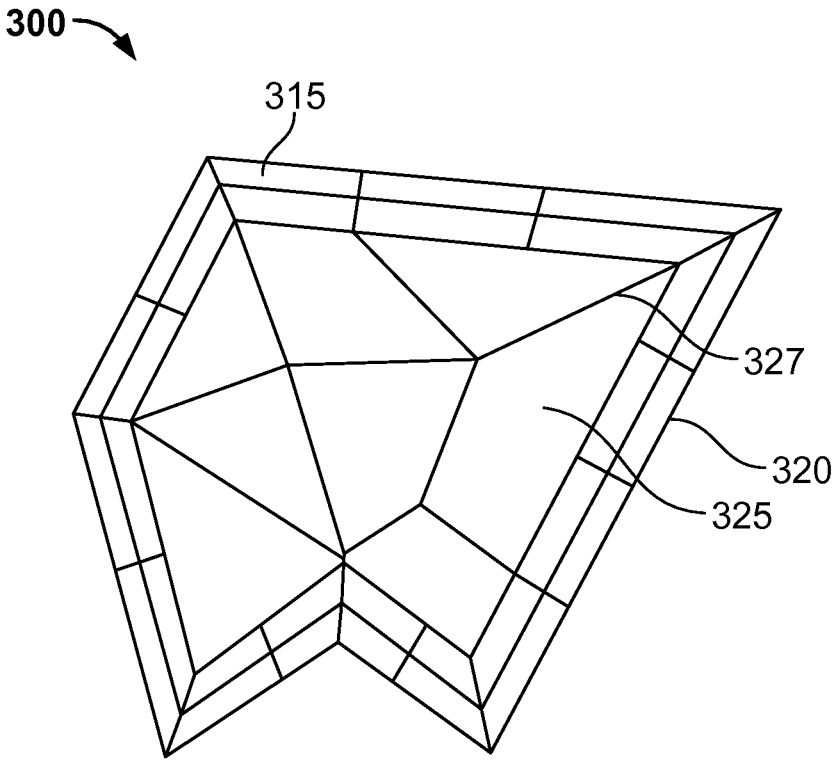
FIG. 3 is a diagram showing an example reservoir block.

FIG. 3 is a diagram showing an example reservoir block that is modeled using an example mesh 300. The example mesh 300 shown in FIG. 3 shows an example mesh geometry of one reservoir block. The reservoir block can be, for example, one of the reservoir blocks 260 shown in FIG. 2. As shown in FIG. 3, the mesh 300 includes mesh lines 327 that define mesh elements. The example mesh 300 has fractures 320 on the boundary. While the example mesh 300 is bounded by segments of the fracture network, these segments may correspond to closed fractures or unphysical segments of the network defined for computational purposes, for example to simplify reservoir block geometry or reduce reservoir block sizes. For example, any suitable boundary conditions may be applied at the outer perimeter of the mesh 300. The fractures 320 can be the segments of the fracture network 270 shown in FIG. 2. In some instances, the mesh 300 is provided with low complexity and high accuracy for modeling fracturing fluid leak-off fluid near the fractures 320.

In some cases, detailed information in the middle (or another region) of the reservoir block may be of less importance in the overall model. In such cases, coarse mesh elements 325 in the middle region may be used to reduce the computational complexity in the mesh 300, and finer resolution mesh elements 315 can be used near the fractures 320. As such, a mesh can have a finer resolution near the physically open fractures, instead of the entire boundary or the entire reservoir block.

The mesh can be generated by any suitable process or algorithm. In some implementations, points are distributed throughout the given block, with spatial density related to the distance from the fractures on the boundary. As such, the points of the mesh 300 are more closely spaced near the fractures 320 than the points of mesh 300 in the middle of the block. In some instances, a Voronoi diagram of these points yields an unstructured mesh of polygonal elements (or control volumes), with smaller size near the fractures 320. This way, considerable savings in computational cost (e.g., memory and computing time, etc.) can be attained by using unstructured meshes of the blocks which have higher resolution in boundary layers near the fractures on the block boundaries.

In some implementations, a coarse mesh can be defined throughout the block, and fine elements can be defined near the fractures. The fine elements can be defined geometrically to be parallel to the fractures, for example, as shown in FIG. 3, which may help to obtain an accurate discretization of flow normal to the fractures. The coarse mesh may be obtained by constructing a Voronoi diagram based on coarsely spaced points or by another technique. For example, a structured mesh (e.g., uniform rectangular) could be defined in a geometrically defined region (e.g., a rectangular box) containing the block and then trimmed to fit the block, followed by postprocessing to eliminate small angles and improve aspect ratios in the elements.

In some cases, a posteriori error indicators can be used to adaptively refine an initial mesh throughout the simulation of fluid flow. The initial mesh may contain coarse elements, may be structured or unstructured, and may or may not contain fine elements along the fractures as described above. As flow occurs from fractures on the block boundary, error indicators can define regions around the fractures where the mesh should be refined.

In some implementations, computational savings in the numerical simulation of the reservoir blocks can also be attained by using a coarse function space, or a family of coarse function spaces, to approximate the flow in the reservoir block. The basis functions in the coarse space can be generated, for example, by solving local problems in regions of the block, on a fine mesh discretization. For example, multiscale finite element methods or multiscale finite volume methods can be used. In some cases, basis functions associated with each fracture can be constructed by solving a system of equations modeling the flow in a local region near that fracture, discretized by a fine mesh. These basis functions may span a finite-dimensional function space of low dimension, proportional to the number of fractures on the boundary of the block.

A mesh generation algorithm can be dependent on time and the leak-off flow. For example, at early times, when a small amount of leak-off fluid has flowed into the block, accurate computation may be needed only in thin regions near the fractures. At later times, when more leak-off fluid has penetrated deeper into the block, a larger portion of the block may need to be finely resolved. Thus a family of moving meshes can be generated adaptively, so that the leak-off flow is finely resolved throughout the simulation. This can be accomplished by enlarging the fine elements in the boundary layer, or by adding more fine elements to extend the boundary layer, by a combination of enlarging and adding fine elements, or by other suitable techniques.

Figure 4A:
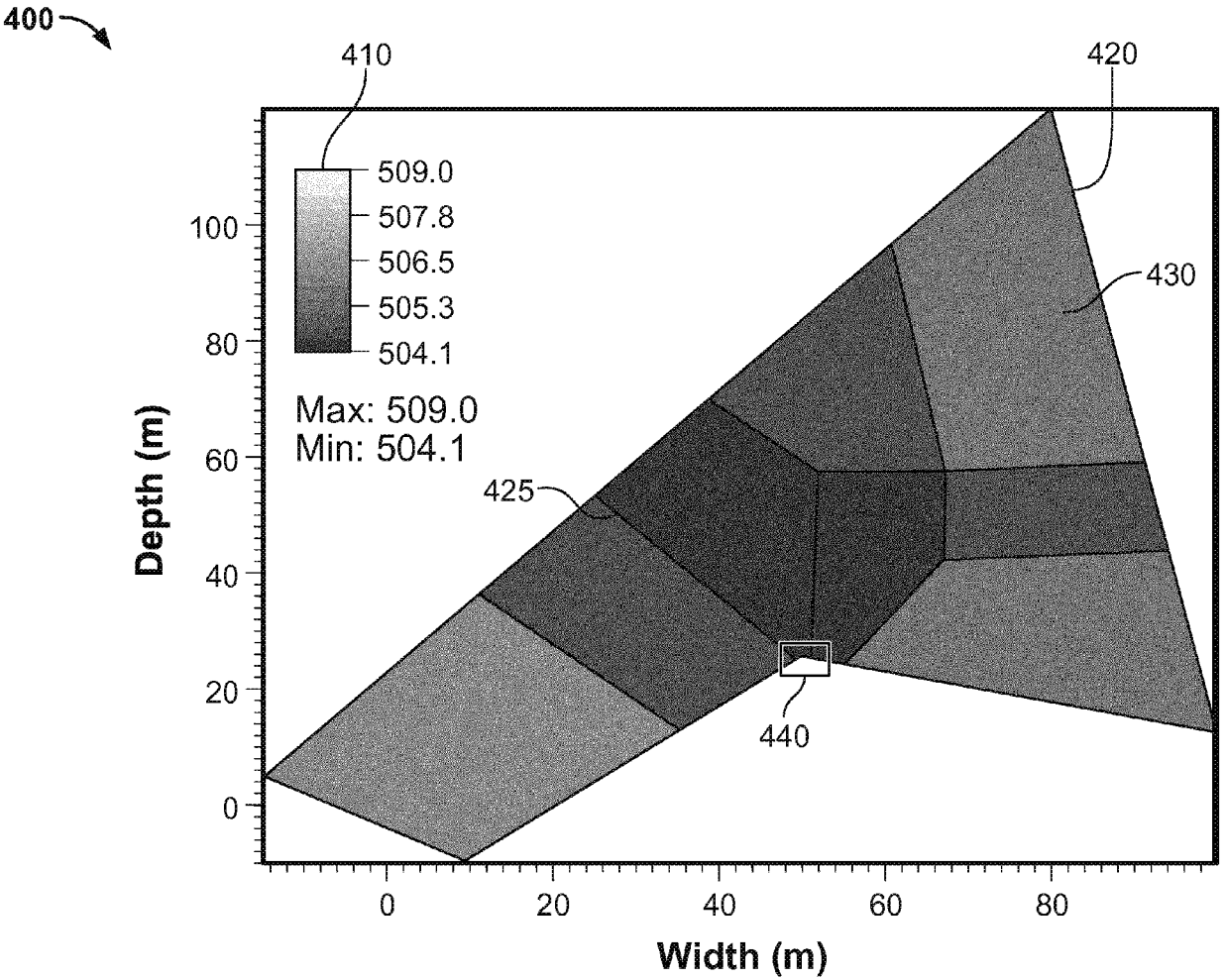
FIG. 4A is a plot showing data relating to an example reservoir block.

FIG. 4A is a plot 400 showing data relating to an example reservoir block model. A mesh 420 discretizing a reservoir block model is plotted in coordinate axes where the x-axis shows the width in meters and the y-axis shows the depth in meters. The mesh 420 can include a number of mesh elements 430 divided by mesh lines 425. In the plot 400, each mesh element 430 is rendered with a color according to the color bar 410. The color bar 410 shows a range of values for pressure between 504.1 pounds per square inch (PSI) and 509 PSI, at an instant in time during a leak-off simulation. The mesh 420 includes a fine mesh region near the fracture boundaries. A detailed view 440 is provided in FIG. 4B to show the fine mesh.

Figure 4B:
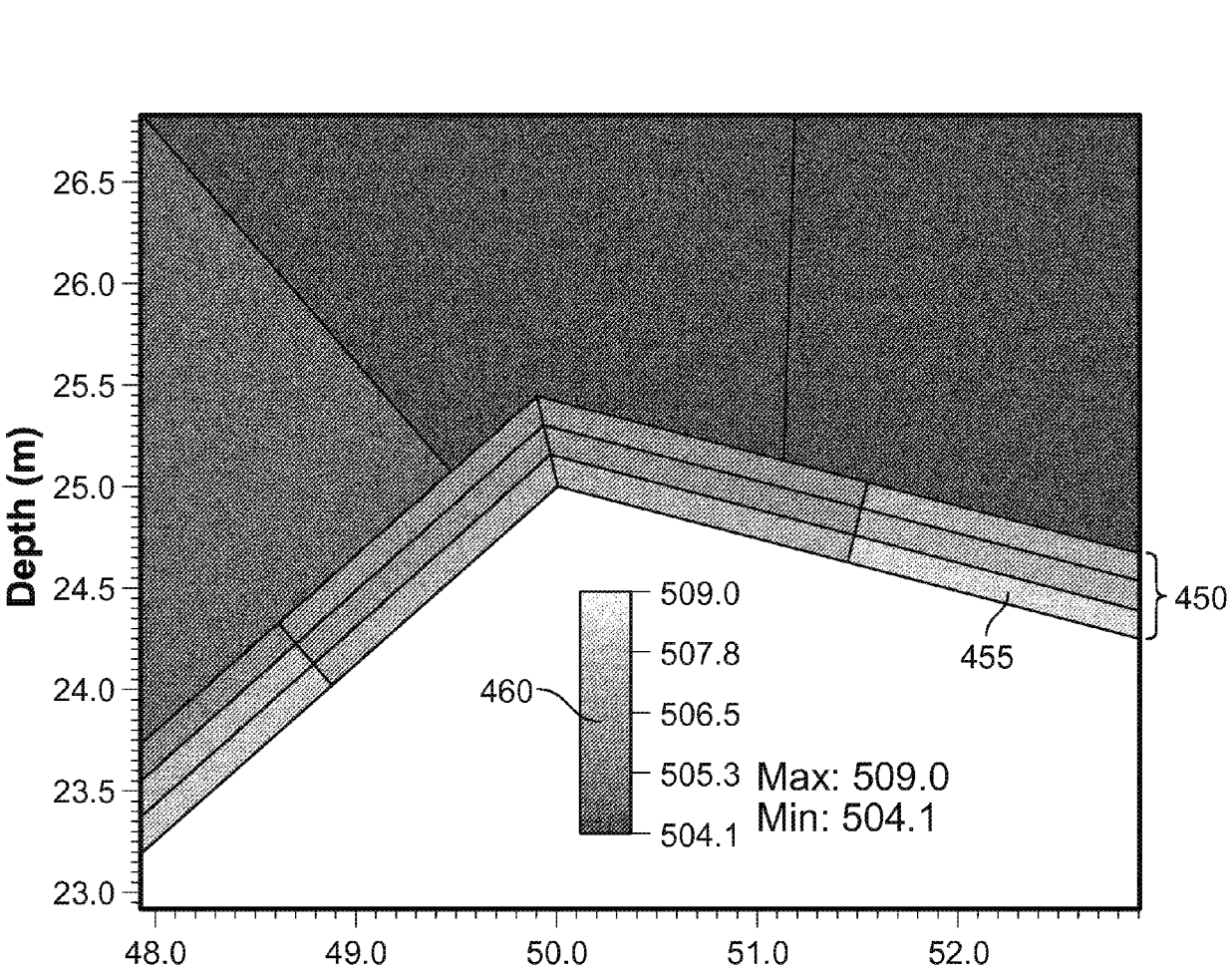
FIG. 4B is a local detail view of the plot shown in FIG. 4A.

FIG. 4B is the local detail view 440 of the plot shown in FIG. 4A. As illustrated by the detail view 440 shown in FIG. 4B, the mesh 420 in FIG. 4A includes a number of mesh elements 455. The mesh elements 455 are rendered in FIG. 4B with a color according to a color bar 460. The local detail view 440 is plotted in a zoomed-in window of which the x-axis shows the width in meters of a narrower range than that of FIG. 4A and the y-axis shows the depth in meters of a narrower range than that of FIG. 4A. The detail view 440 in FIG. 4B reveals a layer of mesh elements 450 at a much finer scale than the coarse elements shown in the plot 400 in FIG. 4A. The mesh elements 450 show data for the pressure near open fractures of an example reservoir block. Similar to the color bar 410, the color bar 460 indicates a range of pressure between 504.1 PSI and 509 PSI. Although in this illustration the color bar 460 shares the same scale as the color bar 410, other scenarios may result in a different range of values for the two color bars 460 and 410. Other types of parameters may be used for a reservoir block model.

Figure 5:
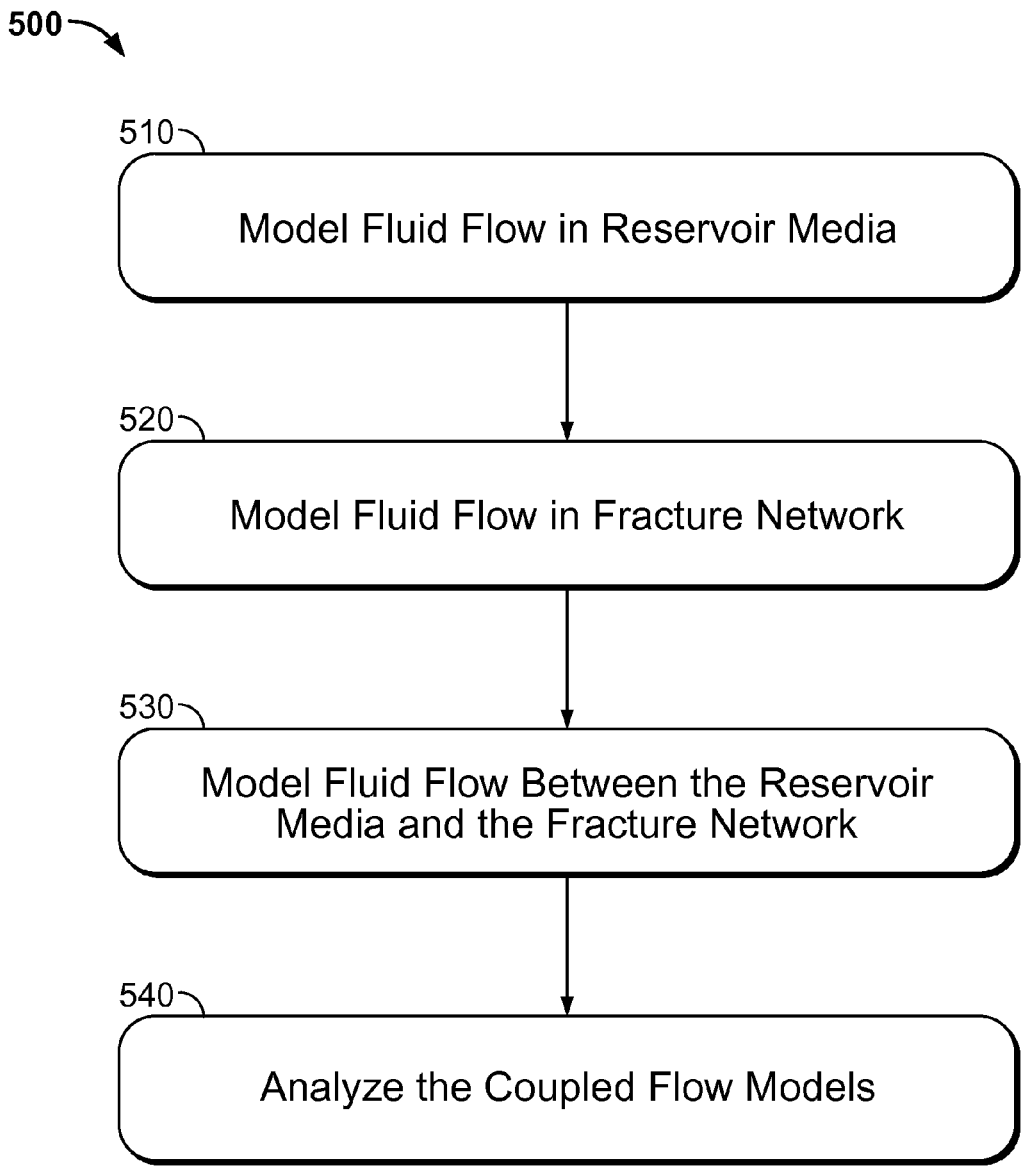
FIG. 5 is a flow chart showing an example technique for modeling fluid flow in a subterranean reservoir.

FIG. 5 is a flow chart showing an example technique 500 for modeling fluid flow in a subterranean reservoir. In some instances, the technique 500 is used to model the flow of fracturing fluid, such as, for example, fluids injected in the subterranean reservoir to induce fractures in the reservoir media. The technique 500 may be used to model the flow of other types of fluids. In some cases, the technique 500 models the flow of multiple fluids. For example, the technique 500 may be used to model the flow of injected fluids along with resident fluids (e.g., water, hydrocarbons, etc.). The technique 500 can model fluid flow in one or more spatial dimensions.

The technique 500 can be implemented by a computing system such as the computing system 120 of FIG. 1B or by another type of computing system. The technique 500 can include the operations shown in FIG. 5, and the technique 500 may include additional, different, or fewer operations. The operations may be performed in the order shown in FIG. 5 or in another order. In some implementations, some or all of the operations shown in FIG. 5 are performed simultaneously, for example, in a fully coupled implicit formulation. In some cases, the operations may be iterated or repeated, as appropriate.

At 510, fluid flow within reservoir media in a subterranean reservoir is modeled with a reservoir block flow model. Fluid flow may be modeled by defining equations, parameters, variables, or other suitable data structures that represent the dynamics of fluid flow within the reservoir media. The reservoir media can include the porous rock or other media of the subterranean reservoir. The reservoir block flow model can identify the geometry of reservoir blocks, geomechancial properties of the reservoir media, materials resident in the reservoir media, thermodynamic conditions in the reservoir media, or any suitable combination of these and other properties of the reservoir. The reservoir block flow model can include equations and other relationships that describe dynamic behavior of fluids in the reservoir media.

The reservoir block flow model can include a mesh representation of the reservoir media. For example, the mesh representation can be similar to the example shown in FIG. 4A, or another type of mesh representation can be used. In some implementations, the reservoir block flow model can model the flow of the fracturing fluid and additional fluids (e.g., water, hydrocarbons, etc.). The reservoir block flow model can model the flow in multiple fluid phases (e.g., liquid, gas, etc.), flow in multiple spatial dimensions, or both. The reservoir block flow model can model flow, for example, in one spatial dimension, two spatial dimensions, or three spatial dimensions.

At 520, fluid flow within a fracture network in the subterranean formation is modeled by a fracture network flow model. Fluid flow may be modeled by defining equations, parameters, variables, or other suitable data structures that represent the dynamics of fluid flow within the subterranean fracture network. The fracture network can include regions of the subterranean reservoir where fluid can flow between blocks of reservoir media. The fracture network flow model can identify the geometry of the fracture network, materials resident in the fracture network, thermodynamic conditions in the fracture network, and other properties of a fracture network. The fracture network flow model can include equations and other relationships that describe dynamic behavior of fluids in the fracture network. In some implementations, the fracture network flow model includes a system of differential equations, and the reservoir block flow model includes another system of differential equations. In some cases, the fracture network flow model identifies fracture segments along the boundaries of the reservoir media.

In some implementations, the fracture network flow model can model the flow of the fracturing fluid and additional fluids (e.g., water, hydrocarbons, etc.). The fracture network flow model can also model the flow in multiple fluid phases (e.g., liquid, gas, etc.), in multiple spatial dimensions, or both. The fracture network flow model can model flow, for example, in one spatial dimension, two spatial dimensions, or three spatial dimensions.

At 530, the reservoir block flow model is coupled with the fracture network flow model. The models may be coupled by defining equations, parameters, variables, or other suitable data structures that represent the dynamics of fluid flow between the fracture network and the reservoir media. An interface flow model can be used to couple the fracture network and the reservoir media. The interface flow model can describe flow between the spatial domain of the fracture network and the spatial domain of the reservoir media (e.g., from the fracture network into the reservoir media, from the reservoir media into the fracture network, or both). The interface flow model can include one or more fluid leak-off models that represent fluid flow across individual segments of the fracture network. The segments can be defined as discrete sections of the fracture network.

In some implementations, the interface flow model includes a set of equations that couples a first system of differential equations representing flow within the reservoir media to a second system of differential equations representing flow within the fracture network. In some instances, the system of coupled differential equations may have one unique solution for any given set of appropriate input parameters.

At 540, the coupled flow models are analyzed. In some instances, flow models are analyzed numerically, for example, by computer simulations. Analysis of the coupled flow models may include solving the coupled flow models. For example, solving the coupled flow models may produce a solution to a set of time-dependent equations that represent the flow of fracturing fluid in the subterranean reservoir. Solving the coupled flow models may produce output data representing characteristics of fracturing fluid leak-off from the fracture network into the reservoir media. The characteristics of fracturing fluid leak-off can include dynamic characteristics. For example, the characteristics may include a time-dependent volume of fracturing fluid leak-off from the fracture network into the reservoir media, a time-dependent rate of fracturing fluid leak-off from the fracture network into the reservoir media, or other characteristics.

Additional or different types of output data can be generated. For example, the output data can include fluid loss concentration and distribution, pressure and pressure distribution, and temperature and temperature distribution. Moreover, the term "output data" is used broadly to encompass any suitable type of information produced by data processing apparatus. Output data may be stored or encoded in any suitable location, format, or medium. In some cases, output data may be displayed to a user, stored in memory, or used for further processing; output data may generally be handled in any manner, as appropriate in a given context.

Analyzing the flow models may include making time-dependent modifications to the mesh representation of the reservoir media. Analyzing the flow models may produce any suitable type of output data. The output data may be presented in a graphical manner, for example, in a two dimensional plot, or a three dimensional plot, or both. The presentation may employ color rendering, value comparison, or other visualization techniques. In some implementations, the rendered presentation may be interactive with users by allowing users to select a portion of the plot for magnification or other data manipulation techniques, such as rotation, panning, and others.

Some embodiments of subject matter and operations described in this specification can be implemented in digital electronic circuitry, or in computer software, firmware, or hardware, including the structures disclosed in this specification and their structural equivalents, or in combinations of one or more of them. Some embodiments of subject matter described in this specification can be implemented as one or more computer programs, i.e., one or more modules of computer program instructions, encoded on computer storage medium for execution by, or to control the operation of, data processing apparatus. A computer storage medium can be, or can be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

Some of the processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing actions in accordance with instructions and one or more memory devices for storing instructions and data. A computer may also include, or be operatively coupled to receive data from or transfer data to, or both, one or more mass storage devices for storing data, e.g., magnetic, magneto optical disks, or optical disks. However, a computer need not have such devices. Devices suitable for storing computer program instructions and data include all forms of non-volatile memory, media and memory devices, including by way of example semiconductor memory devices (e.g., EPROM, EEPROM, flash memory devices, and others), magnetic disks (e.g., internal hard disks, removable disks, and others), magneto optical disks, and CD ROM and DVD-ROM disks. The processor and the memory can be supplemented by, or incorporated in, special purpose logic circuitry.

To provide for interaction with a user, embodiments of the subject matter described in this specification can be implemented on a computer having a display device (e.g., a CRT (cathode ray tube) or LCD (liquid crystal display) monitor, or another type of display device) for displaying information to the user and a keyboard and a pointing device (e.g., a mouse, a trackball, a tablet, a touch sensitive screen, or another type of pointing device) by which the user can provide input to the computer. Other kinds of devices can be used to provide for interaction with a user as well, for example, feedback provided to the user can be any form of sensory feedback, e.g., visual feedback, auditory feedback, or tactile feedback, and input from the user can be received in any form, including acoustic, speech, or tactile input. In addition, a computer can interact with a user by sending documents to and receiving documents from a device that is used by the user, for example, by sending web pages to a web browser on a user's client device in response to requests received from the web browser.

A client and server are generally remote from each other and typically interact through a communication network. Examples of communication networks include a local area network ("LAN") and a wide area network ("WAN"), an inter-network (e.g., the Internet), a network comprising a satellite link, and peer-to-peer networks (e.g., ad hoc peer-to-peer networks). The relationship of client and server arises by virtue of computer programs running on the respective computers and having a client-server relationship to each other.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

A number of embodiments have been described. Nevertheless, it will be understood that various modifications may be made without departing from the spirit and scope of the invention. Accordingly, other embodiments are within the scope of the following claims.

The invention claimed is:

1. A computer-implemented method for modeling fracturing fluid leak-off in a subterranean formation, the method comprising:

modeling, with a reservoir block flow model, fluid flow in multiple fluid phases and in multiple spatial dimensions within reservoir media in a subterranean formation;

modeling, with a fracture network flow model, fluid flow within a fracture network in the subterranean formation;

modeling, with an interface flow model, fluid flow between the fracture network and the reservoir media, wherein the interface flow model comprises a filtration with linear-invasion and crossflow (FLIC) model with a time-dependent pressure drop across a filter-cake on a fracture face;

wherein the reservoir block flow model includes a mesh representation of the reservoir media, the mesh representation including a plurality of mesh elements, the mesh representation bounded by a boundary, the boundary representing fractures of the fracture network;

wherein the mesh representation comprises coarser resolution mesh elements in the middle region and finer resolution mesh elements near the boundary;

wherein the fracture network flow model includes a first system of differential equations, the reservoir block flow model includes a second system of differential equations, and the interface flow model includes a third set of equations that couples the first system of differential equations with the second system of differential equations; and generating output data representing characteristics of fracturing fluid leak-off from the fracture network into the reservoir media, the output data generated based on coupling the fracture network flow model, the reservoir block flow model, and the interface flow model, wherein generating the output data includes making time-dependent modifications to the mesh representation that includes the plurality of mesh elements.

2. The method of claim 1, wherein the characteristics of fracturing fluid leak-off include at least one of:

a time-dependent volume of fracturing fluid leak-off from the fracture network into the reservoir media; or a time-dependent rate of fracturing fluid leak-off from the fracture network into the reservoir media.

3. The method of claim 1, wherein the reservoir block flow model identifies boundaries of the reservoir media and the fracture network flow model identifies fracture segments along the boundaries of the reservoir media.

4. The method of claim 3, wherein the interface flow model represents fluid flow between the fracture network and the reservoir media for each of the fracture segments individually.

5. The method of claim 1, wherein the output data are generated based on solving a time-dependent system of coupled differential equations.

6. The method of claim 5, wherein the time-dependent system of coupled differential equations has a unique solution given a set of input parameters.

7. The method of claim 1, wherein generating the output data includes:

modeling time-dependent flow of one or more fluids in the subterranean formation; and wherein making time-dependent modifications to the mesh representation of the reservoir media includes refining mesh elements of an initial mesh representation of the reservoir media.

8. The method of claim 1, wherein the reservoir media includes porous rock.

9. The method of claim 1, comprising modeling, with the reservoir block flow model and the fracture network flow model, the flow of the fracturing fluid and at least one additional fluid.

10. The method of claim 9, comprising modeling, with the reservoir block flow model and the fracture network flow model, flow multiple fluid phases.

11. The method of claim 1, comprising modeling, with the reservoir block flow model, fluid flow in one spatial dimension, two spatial dimensions or in three spatial dimensions.

12. The method of claim 11, comprising modeling, with the fracture network flow model, fluid flow in one spatial dimension, two spatial dimensions or in three spatial dimensions.

13. The method of claim 1, wherein the output data further comprise fluid loss concentration and distribution, pressure and pressure distribution, and temperature and temperature distribution.

14. A non-transitory computer-readable medium encoded with instructions for modeling fracturing fluid leak-off in a subterranean formation, the instructions operable when executed by data processing apparatus to perform operations comprising:

modeling, with a reservoir block flow model, fluid flow in multiple fluid phases and in multiple spatial dimensions within reservoir media in a subterranean formation;

modeling, with a fracture network flow model, fluid flow within a fracture network in the subterranean formation;

modeling, with an interface flow model, fluid flow between the fracture network and the reservoir media, wherein the interface flow model comprises a filtration with linear-invasion and crossflow (FLIC) model with a time-dependent pressure drop across a filter-cake on a fracture face;

wherein the reservoir block flow model includes a mesh representation of the reservoir media, the mesh representation including a plurality of mesh elements, the mesh representation bounded by a boundary, the boundary representing fractures of the fracture network;

wherein the mesh representation comprises coarser resolution mesh elements in the middle region and finer resolution mesh elements near the boundary;

wherein the fracture network flow model includes a first system of differential equations, the reservoir block flow model includes a second system of differential equations, the interface flow model includes a third set of equations that couples the first system of differential equations with the second system of differential equations; and generating output data representing characteristics of fracturing fluid leak-off from the fracture network into the reservoir media, the output data generated based on coupling the fracture network flow model, the reservoir block flow model, and the interface flow model, wherein generating the output data includes making time-dependent modifications to the mesh representation that includes the plurality of mesh elements.

15. The computer-readable medium of claim 14, wherein generating the output data includes:

modeling time-dependent flow of one or more fluids in the subterranean formation; and wherein making time-dependent modifications to the mesh representation of the reservoir media includes refining mesh elements of an initial mesh representation of the reservoir media.

16. The computer-readable medium of claim 14, wherein the reservoir block flow model and the fracture network flow model each model fluid flow in multiple spatial dimensions.

17. A computer system for modeling fracturing fluid leak-off in a subterranean formation, the computer system comprising data processing apparatus operable to execute:

a reservoir block flow module operable to model fluid flow in multiple fluid phases and in multiple spatial dimensions within reservoir media in a subterranean formation;

a fracture network flow module operable to model fluid flow within a fracture network in the subterranean formation;

an interface flow module operable to model fluid flow between the fracture network and the reservoir media, wherein the interface flow module comprises a filtration with linear-invasion and crossflow (FLIC) model with a time-dependent pressure drop across a filter-cake on a fracture face;

wherein the reservoir block flow module operable to generate a mesh representation of the reservoir media, the mesh representation including a plurality of mesh elements, the mesh representation bounded by a boundary, the boundary representing fractures of the fracture network;

wherein the mesh representation comprises coarser resolution mesh elements in the middle region and finer resolution mesh elements near the boundary;

wherein the fracture network flow module includes a first system of differential equations, the reservoir block flow module includes a second system of differential equations, the interface flow module includes a third set of equations that couples the first system of differential equations with the second system of differential equations; and a global flow module that couples the fracture network flow module, the reservoir block flow module, and the interface flow module, the global flow module being operable to generate output data representing characteristics of fracturing fluid leak-off from the fracture network into the reservoir media, wherein generating the output data includes making time-dependent modifications to the mesh representation that includes the plurality of mesh elements.

18. The computer system of claim 17, further comprising a display apparatus operable to present a graphical user interface based on the output data.

* * * * *